US005413512A

United States Patent [19]

Belenger

[11] Patent Number: 5,413,512

[45] Date of Patent: May 9, 1995

[54] MULTI-PROPELLER DRIVE SYSTEM

[75] Inventor: Robert V. Belenger, Raynham, Mass.

[73] Assignee: The United States of America as represented by the Secretary of the Navy, Washington, D.C.

[21] Appl. No.: 273,438

[22] Filed: Jul. 5, 1994

[51] Int. Cl.[6] ..... B63H 21/28

[52] U.S. Cl. ..... 440/74; 440/75; 440/80

[58] Field of Search ..... 440/49, 53, 75, 74, 440/79, 80, 83

[56] References Cited

U.S. PATENT DOCUMENTS

| | | | |
|---|---|---|---|
| 3,112,728 | 12/1963 | Krause | 440/75 |
| 3,922,997 | 12/1975 | Jameson | 440/75 |
| 4,451,238 | 5/1984 | Arnold | 440/74 |
| 4,820,209 | 4/1989 | Newman | 440/74 |

*Primary Examiner*—Stephen P. Avila
*Attorney, Agent, or Firm*—Michael J. McGowan; Prithvi C. Lall; Michael F. Oglo

[57] ABSTRACT

A multi-propeller drive system having a single input shaft for connection to an engine system, a differential gear assembly for dividing the driving force from the input drive shaft between a pair of output shafts and a pair of laterally spaced propellers driven by the output shafts of the differential gear assembly. The differential gear assembly operates in a manner wherein one output shaft, if required, is permitted to revolve at a different rate than the other output shaft. A pair of brake mechanisms acting on the output shafts of the differential gear assembly enable an operator to control the rotational speed of the respective propellers without modifying the engine speed or transmission settings.

13 Claims, 1 Drawing Sheet

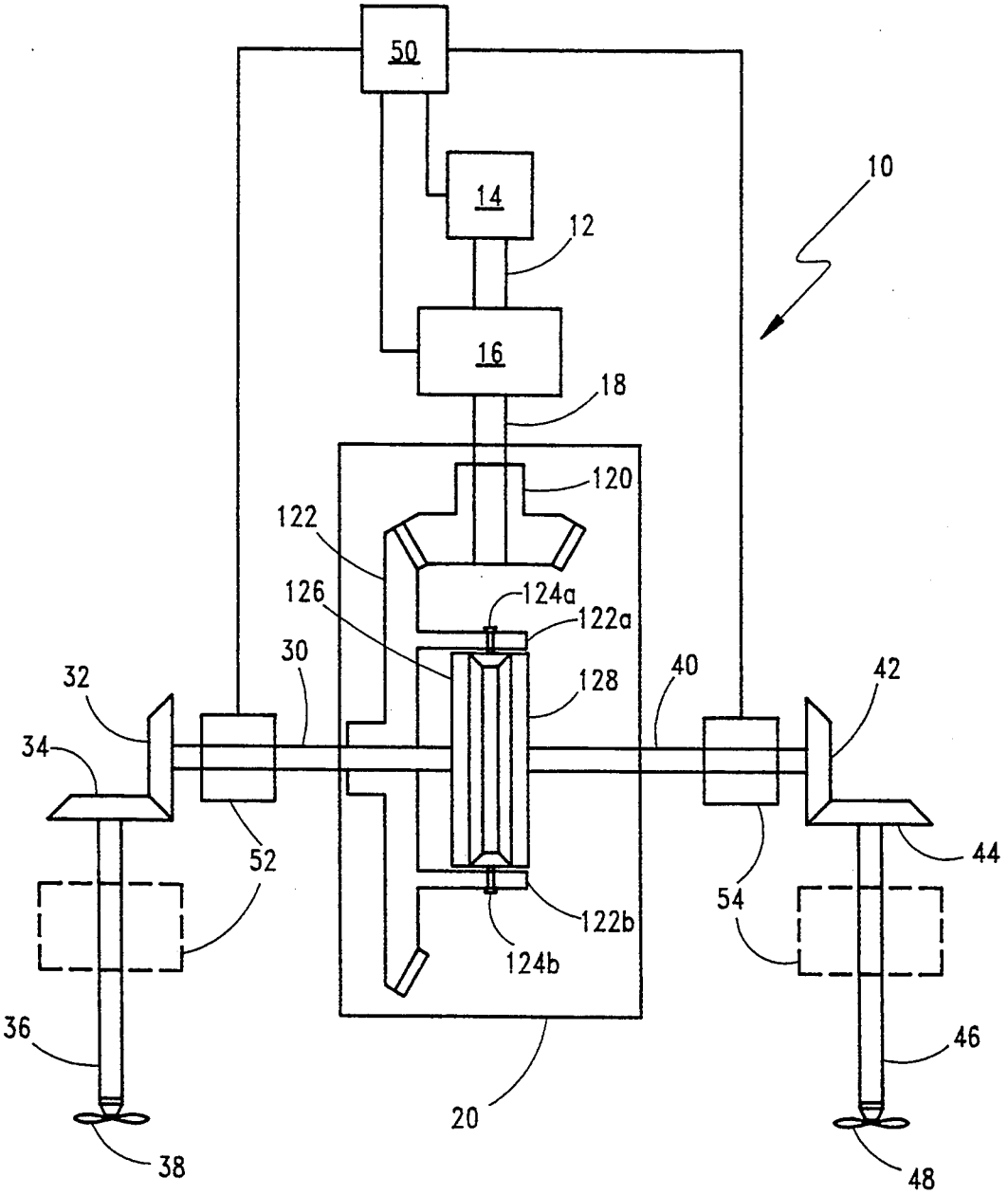
50
14
12
10
16
18
120
122
126
124a
122a
30
128
40
42
32
34
52
44
54
122b
124b
36
46
20
38
48

MULTI-PROPELLER DRIVE SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to dual propeller drive systems and more particularly to a device for converting a single drive shaft to a multi-propeller drive system.

(2) Description of the Prior Art

As is well known in the art, dual propeller systems provide for greater maneuverability and for greater directional stability against wind and water currents than do single propeller drive systems. Increased maneuverability and directional stability make navigation through crowded waters easier and facilitates docking of a ship. Dual propeller drive systems obtain this greater maneuverability and directional stability by individually controlling propeller speed in a such manner as to allow the propellers to rotate at different speeds. Rotating the propellers at different speeds enables the ship to change its course without having to change the position of the propellers or the position of a rudder.

While various conventional arrangements have been developed to obtain the benefit of individually controllable propeller speeds, such arrangements generally suffer from one or more disadvantages. For example, some of these arrangements use a separate engine and transmission system for each propeller. This generally increases the size, weight and expense of the system and requires a corresponding increase in the amount of time and expense required to maintain the system. Other arrangements, such as that described in U.S. Pat. No. 3,112,728, use a single engine with separate transmission systems for each propeller. However, such dual transmission arrangements suffer from the added size, expense, and required maintenance associated with a second transmission system.

A dual propeller drive system using a single transmission is described in U.S. Pat. No. 3,922,997. However, the single transmission system of U.S. Pat. No. 3,922,997 requires separate gear sets, clutch assemblies and associated control elements for each propeller drive shaft. The use of separate gear sets, clutches and control elements generally increases the size, expense, complexity, and/or required maintenance of the propeller drive systems. None of the currently available devices or methods implement a multi-propeller drive system that allows the speed of each propeller to be independently controlled without using relatively expensive and complex equipment or a separate engine and transmission system for each propeller.

SUMMARY OF THE INVENTION

Accordingly, it is a general purpose and object of the present invention to provide a multi-propeller drive system wherein the speed of each propeller can be individually controlled.

Another object is to provide a multi-propeller drive system wherein the speed of each propeller can be individually controlled allowing the propellers to rotate at the same or different speeds without requiring relatively expensive, sizeable and/or complex equipment.

A further object is to provide a multi-propeller drive system wherein each propeller can rotate at the same or different speeds without requiring separate engines and/or transmission systems for each propeller drive shaft.

Yet another object is the provision of an apparatus for converting a single propeller drive system to a multi-propeller drive system wherein the speed of each propeller can be individually controlled which does not require relatively expensive, sizeable and/or complex equipment to implement.

These and other objects are accomplished with the present invention by providing at least two laterally spaced propellers driven by output shafts from a differential having a single input drive shaft. The differential divides the driving force from the input drive shaft between the output shafts in a manner wherein one output shaft, if required, is permitted to revolve at a different rate than the other output shafts. At least one brake mechanism is disposed between the output shaft of the differential and a propeller to enable an operator to control rotational speed of the respective propellers without modifying engine speed or transmission settings.

BRIEF DESCRIPTION OF THE DRAWINGS

A more complete understanding of the invention and many of the attendant advantages thereto will be readily appreciated as the same becomes better understood by reference to the following detailed description when considered in conjunction with the sole accompanying drawing which shows a schematic diagram of a single drive shaft to multi-propeller drive system in accordance with the present invention.

DESCRIPTION OF THE PREFERRED EMBODIMENT

Referring now to the sole figure in the case, there is shown a schematic diagram of a single drive shaft to multi-propeller drive system 10 of the present invention. Shaft 12 is driven by engine 14, such as an internal combustion engine or the like, and is the input drive shaft for transmission 26. Transmission 16, which also includes output drive shaft 18, controls the rotational speed and direction of shaft 18. The construction and operation of transmission 16 is conventional in nature and will not be described in detail. In general, transmission 16 will be of the type containing forward and reverse gear assemblies and a suitable control mechanism, such as a fluid actuated multiple-disk clutch assembly or the like, for selectively engaging the forward or reverse gears. However, it is understood that the specific construction and operation of transmission 16 is determined by several factors such as the output power and speed required at drive shaft 18.

Drive shaft 18 is the input drive shaft for differential 20. Differential 20 is an arrangement of gears, typically forming an epicyclic train, for driving first and second output shafts 30 and 40. Differential 20 operates in a manner wherein the driving force from drive shaft 18 is divided, preferably equally, between output shafts 30 and 40 and wherein one output shaft, when required, is permitted to revolve slower than the other output shaft. In differential 20, bevel gear 120 is keyed to drive shaft 18 such that bevel gear 120 rotates with shaft 18. Bevel gear 120 meshes with ring gear 122, causing ring gear 122 to rotate around output shaft 30 as bevel gear 120 rotates. Ring gear 122, which rotates freely around output shaft 30, carries arms 122*a* and 122*b*. Arms 122*a* and 122*b* carry planet gears 124*a* and 124*b*, respectively, which mesh with first and second differential output gears 126 and 128. Gears 126 and 128 are keyed to output shafts 30 and 40, respectively, such that each of the output shafts 30 and 40 rotates together with its respective differential output gear.

When output shafts 30 and 40 rotate freely with no forces acting to slow one of the shafts, both shafts 30 and 40 rotate at the same speed, equal to the speed at which ring gear 122 rotates. If, however, either one of the output shafts 30 or 40 is slowed, the rate at which the other output shaft 30 or 40 rotates increases. For example, if output shaft 30 is slowed, the angular velocity of differential output gear 126 will likewise be reduced and, therefore, differential output gear 126 will be rotating slower than ring gear 122. This difference in angular velocity of gears 126 and 122 will cause planet gears 124*a* and 124*b* to rotate. The rotation of planet gears 124*a* and 124*b* drives differential output gear 128, thereby causing gear 128 and output shaft 40 to rotate faster than ring gear 122. Preferably, differential output gears 126 and 128 have the same number of teeth so that the train value e is −1 and, therefore, each output shaft 30 or 40 will exhibit the same increase in speed in response to a decrease in the speed of the other shaft. Differential 20, as shown in the figure and described above, is similar to a conventional automobile differential; however, any differential which operates in a like manner can be used.

Output shaft 30 carries a first output drive gear 32 which meshes with a first propeller drive gear 34. Gear 34 is keyed to propeller shaft 36. Thus, gears 32 and 34 provide a means for transmitting motion from output shaft 30 to propeller shaft Preferably, shafts 30 and 36 have axes which intersect at a 90° angle and gears 32 and 34 are bevel-type gears, as such an arrangement provides an efficient means of transmitting motion from output shaft 30 to propeller shaft 36. However, it is understood that the axes of shafts 30 and 36 could be offset (nonparallel and nonintersecting) as well as crossing or intersecting at angles other than 90°. Likewise, motion can be transmitted from output shaft 30 to propeller shaft 36 through gears 32 and 34 or by other means including additional gearing, chain drives, or flexible belts. Motion is transmitted from output shaft 40 to propeller shaft 46 through a second output drive gear 42 and a second propeller drive gear 44 in a similar manner. That is, output shaft 40 carries gear 42 which meshes with gear 44 which, in turn, is keyed to propeller shaft 46.

First and second propellers 38 and 48 are coupled to propeller shafts 36 and 46, respectively. Propellers 38 and 48 can be coupled directly to their respective shafts or other coupling means such as additional shafts and intermediate gearing or the like could be used. To provide increased maneuverability and stability, propeller shafts 36 and 46 and propellers 38 and 48 are laterally spaced on opposite sides of the centerline of the ship. Preferably, propeller shafts 36 and 46 are parallel with the centerline and propellers 38 and 48 are spaced an equal distance from the centerline.

First and second brake mechanisms 52 and 54, which can be shoe-type brakes, disk-type brakes or the like, are used to slow the angular speed of output shafts 30 and 40, respectively, thereby slowing the angular speed of propellers 38 and 48 as well. Alternatively, propeller 38 can be slowed by using brake mechanism 52 to slow the speed of propeller shaft 36. Similarly, the speed of propeller 48 can be slowed by using a brake mechanism acting on propeller shaft 46. However, because only a single brake mechanism is needed to slow each individual propeller, brake mechanism 52 acting on propeller shaft 36 and brake mechanism 54 acting on propeller shaft 46 are shown with a broken line in the figure.

Engine 14, transmission 16, and brakes 52 and 54 are connected to operator control unit 50 which provides the ability to selectively and independently operate the transmission, brakes, and engine from a remote location. The construction of operator control unit 50 is conventional in nature and is not illustrated or described in detail. In general, operator control unit 50 contains suitable control means such as one or more levers, pedals, buttons or the like in communication with engine 14, transmission 16, and brakes 52 and 54 for effecting control of the engine, transmission and brakes. Operator control unit 50 can communicate with transmission 16, brake mechanisms 52 and 54 and engine 14 through any of several conventional means including, but not limited to, electrical means, hydraulic means or a combination thereof.

In accordance with the present invention, operator control unit 50 is used to selectively engage brake mechanisms 52 and 54 thereby enabling one to control the relative speed of rotation of propellers 38 and 48 and thus control the bearing of the ship. For example, if it is desired to turn to the right while the ship is underway forward, then brake 54 would be engaged to reduce the speed of shaft 40 and propeller 48, assuming that the propellers shown are at the stern and are rotating to push the ship forward. Reducing the speed of shaft 40 increases the speed of shaft 30 and propeller 38. Since propeller 38 is now rotating faster than propeller 48, the ship will undergo a turning movement to the right. Further engaging brake 54 increases the force that brake 54 applies to shaft 40, thereby further reducing the speed of shaft 40 and increasing the speed of shaft 30. This creates a greater difference in the relative speeds of propellers 38 and 48 and thus provides a greater turning movement to the right. The greatest turning effort for a given speed occurs when brake 54 is fully engaged thereby stopping shaft 40 and propeller 48. Similarly, a turning effort to the left can be accomplished by progressively engaging brake 52. The progressive engagement of a brake from a remote location is well known in the art of brake systems.

Additionally, operator control unit 50 can be used to control engine 14 and transmission 16 thereby enabling one to control the relative speed and direction of rotation of drive shaft 18 and thus control the speed and forward/reverse direction of the ship. For example, operator control unit 50 can include one control mechanism to selectively engage the forward or reverse gear assemblies of transmission 16 and a separate control mechanism in communication with engine 14 to vary the speed of shaft 12 to obtain a desired propeller speed and direction. Alternatively, engine 14 can be provided with a suitable speed control mechanism connected to the control mechanism for transmission 16. Such interconnection of an engine throttle mechanism with the transmission control mechanism is considered to be well known in the art of marine engine controls.

The device provides a novel approach for converting a single propeller drive system to a multi-propeller drive system wherein each propeller drive shaft may rotate at the same or different speeds and offers significant advantages over prior art systems. First, it allows for increased maneuverability and stability associated with multi-propeller drive systems without requiring relatively expensive, sizeable or complex equipment to implement. Second, the device can easily be fitted to existing propeller drive systems to provide benefits of dual propeller drive systems wherein the speed of each propeller may be individually controlled to ships currently without such ability.

Obviously many modifications and variations of the present invention may become apparent in light of the above teachings. In light of the above, it is therefore understood that within the scope of the appended claims, the invention may be practiced otherwise than as specifically described.

What is claimed is:

1. A drive system comprising:

a differential means, having an input drive shaft and a plurality of output drive shafts, for dividing rotational motion from said input drive shaft between said plurality of output drive shafts wherein one output drive shaft may rotate at a different rate than the other output drive shafts;

a plurality of shaft coupling means, each shaft coupling means keyed to a corresponding one of said output drive shafts of said differential means, for transferring rotational motion from said output drive shafts;

a plurality of propulsion drive shafts, each propulsion drive shaft drivenly coupled to a corresponding one of said shaft coupling means, for rotating therewith; and at least one brake mechanism disposed between said output drive shafts of said differential means and said propulsion drive shafts, said brake mechanism being selectively engageable for changing the rotational speed of one propulsion drive shaft with respect to the other propulsion drive shafts.

2. The drive system of claim 1 further comprising:

a plurality of propellers; and a plurality or propeller coupling means drivingly coupling each of said propellers to a corresponding one of said propulsion drive shafts.

3. The drive system of claim 2 further comprising an operator control unit in communication with each brake mechanism for selectively engaging and effecting control of each brake mechanism.

4. The drive system of claim 3 wherein said differential means comprises:

a bevel gear drivenly connected to said input drive shaft;

a ring gear meshed with said bevel gear, said ring gear having at least to two arms, each of said arms carrying a planet gear; and a plurality of output gears each of said output gears in mesh with said planet gears and keyed to a corresponding one of said output drive shafts.

5. The drive system of claim 1 further comprising:

a transmission, having an input shaft and a transmission output shaft, said transmission output shaft being coupled to said input drive shaft of said differential means; and an engine, drivenly connected to said input shaft of said transmission for providing a means of motive power.

6. The drive system of claim 5 further comprising an operator control unit in communication with said engine, said transmission and each brake mechanism, for selectively engaging and effecting control of said engine, said transmission and each brake mechanism.

7. The drive system of claim 6 wherein said differential means comprises:

a bevel gear drivenly connected to said input drive shaft;

a ring gear meshed with said bevel gear, said ring gear having at least to two arms, each of said arms carrying a planet gear; and a plurality of output gears each in mesh with said planet gears and keyed to a corresponding one of said output drive shafts.

8. A multi-propeller drive system comprising:

a differential means, having an input drive shaft and a pair of output drive shafts, for dividing rotational motion from said input drive shaft to said pair of output drive shafts wherein one output drive shaft may rotate at a different rate than the other output drive shaft;

a pair of propeller drive shafts, each of said propeller drive shafts having coupling means drivingly connecting each said propeller drive shaft to a respective rotating output drive shaft; and a pair of brake mechanisms disposed between said output shafts and said respective propeller drive shafts, said brake mechanisms being selectively engageable for changing the angular speed of one propeller drive shaft with respect to the angular speed of the other propeller drive shaft.

9. The multi-propeller drive system of claim 8 further comprising an operator control unit in communication with said pair of brake mechanisms for selectively engaging said brake mechanisms.

10. The multi-propeller drive system of claim 9 further comprising:

a pair of propellers; and a pair of propeller coupling means each drivingly coupling a corresponding one of said propellers to a corresponding one of said propeller drive shafts.

11. The multi-propeller drive system of claim 10 further comprising:

a transmission having a transmission input shaft and a transmission output shaft, said transmission output shaft being coupled to said input drive shaft of said differential means; and an engine drivingly coupled to said transmission input shaft, for providing a means of motive power.

12. The multi-propeller drive system of claim 11 wherein said operator control means further communicates with said engine and said transmission for selectively engaging and effecting control of said engine and said transmission.

13. The multi-propeller drive system of claim 12 wherein said differential means comprises:

a bevel gear keyed connected to said input drive shaft;

a ring gear meshed with said bevel gear, said ring gear having two arms, each of said arms carrying a planet gear; and a pair of output gears each of said output gears in mesh with said planet gears and keyed to a corresponding one of said output drive shafts.

* * * * *